United States Patent [19]

Gindri

[11] 4,200,278

[45] Apr. 29, 1980

[54] SORTING APPARATUS FOR REPRODUCTION MACHINE PRODUCING SIMPLEX AND DUPLEX COPIES

[75] Inventor: Eridiano Gindri, Ivrea, Italy

[73] Assignee: Ing. C. Olivetti & C., S.p.A., Ivrea, Italy

[21] Appl. No.: 875,291

[22] Filed: Feb. 6, 1978

[30] Foreign Application Priority Data

Feb. 18, 1977 [IT] Italy ..... 67357 A/77

[51] Int. Cl.[2] ..... B65H 39/10

[52] U.S. Cl. ..... 271/296; 271/186; 271/259

[58] Field of Search ..... 271/64, 173, 186, 65, 271/258, 259

[56] References Cited

U.S. PATENT DOCUMENTS 3,848,868 11/1974 Stemmle ..... 271/173

3,866,904 2/1975 Stemmle ..... 271/173

4,026,539 5/1977 Knoops ..... 271/173

*Primary Examiner*—Richard A. Schacher

*Attorney, Agent, or Firm*—W. R. Hulbert

[57] ABSTRACT

A sorting and collating apparatus for sorting sheets from a reproduction machine capable of producing simplex or duplex copies, comprising an array of regularly spaced trays fixedly mounted on a suitable frame, a sheets conveyor extending along first and second paths parallel to the opposite sides of the array respectively, a deflector for deflecting sheets to the first path of the conveyor or the second path of the conveyor depending on whether a simplex or duplex sorting is selected, first and second delivering devices connected together and mounted on said conveyor for delivering a transported sheet to a selected tray from either side of the array and a single device for incrementally moving the first and second delivering devices along the array in opposite direction.

5 Claims, 5 Drawing Figures

SORTING APPARATUS FOR REPRODUCTION MACHINE PRODUCING SIMPLEX AND DUPLEX COPIES

BACKGROUND OF THE INVENTION

The present invention refers to a sorting and collating apparatus for sorting sheets from a reproduction machine capable of producing simplex and duplex copies, of the type comprising an array of regularly spaced tray members fixedly mounted on a suitable frame and belt conveying devices extending adjacent and along the array for transporting the copy sheets from a copy input station to a selected tray. A sorting apparatus of the above type is known from the U.S. Pat. No. 3,866,904, in which, in order to collect in an array of tray members either simplex copies or duplex copies, there is provided a vertically extending array of tray members movable past different copy input stations for receiving the sheets. One transport path transports simplex copies, and turns the sheets before discharging them into the trays. A second transport path directs duplex copies through another sheet discharge zone at the opposite side of the trays. Cam members, formed with low pitch spiral camming surfaces and with high pitch spiral camming surfaces, positioned adjacent to the sheet discharge zone, to effect a spreading movement of the trays, drive the array of tray members. Such a machine is slow, due to the inertia of the mass of the vertically movable trays in movement.

Known in the art are sorting apparatus of the above type in which, in order to collect in a try in the right order either duplex copy sheets or simplex copy sheets it is provided a suitable device for turning over upside down a copy sheet before transporting it to a selected tray.

These type of sorting apparatus has the drawback of being slow due to the additional turnover operation.

SUMMARY OF THE INVENTION

An object of the present invention is therefore that of providing a sorting and collating apparatus having high speed, high reliability without additional devices for the turnover of the copy sheets. A further object of the present invention is the provision of a relatively simple sheet distributing device utilizing sheet deflector means which can be moved into different station positions to divert sheets into selected trays.

According to the present invention there is provided a sorting apparatus for receiving sheets from a reproduction machine distributing in both simplex and duplex modes of operation, consisting of a frame, trays fixed to the frame and spaced at regular intervals along a given direction, a two path transport system which is parallel to the direction of the trays with one path on one side of the trays and the other path on the other side, a mechanism to deflect copy sheets to the desired path of the transport system, a device on each path to deliver copy sheets to the appropriate tray, a connection between the two delivery devices such that they move in opposite directions along their respective paths and controls to control the incremental movement of the devices in opposite directions along their respective paths in either one of two opposite and predetermined sequences according to whether simplex or duplex sorting is required.

BRIEF DESCRIPTION OF THE DRAWINGS

This and other objects of the invention will be clear from the following description which refers to the accompanying drawings in which.

DESCRIPTION OF THE PREFERRED EMBODIMENT

Figure 1:
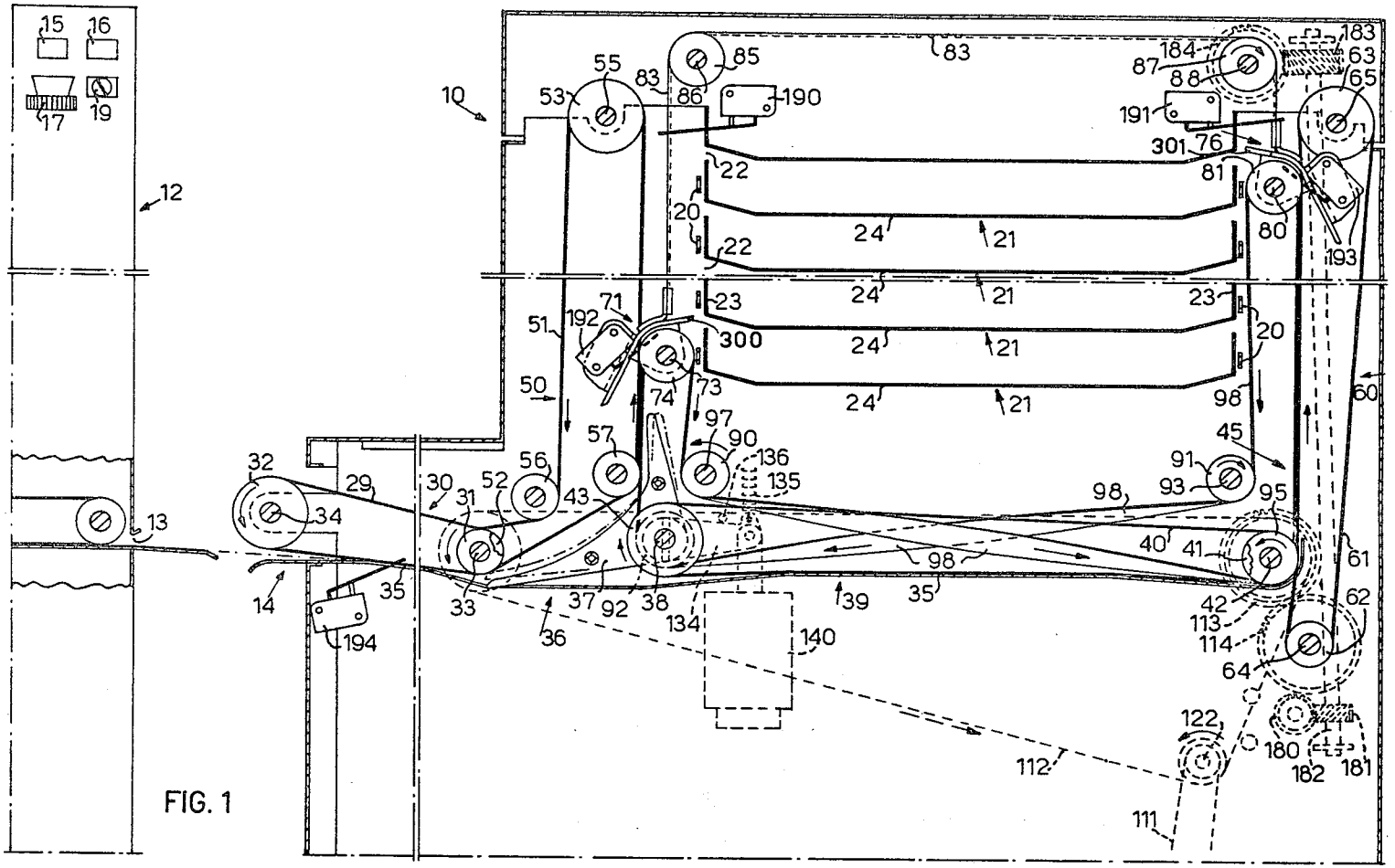
FIG. 1 is a partially sectional elevation view of the sorting apparatus according to the invention operatively connected to a copying machine.
Figure 2:
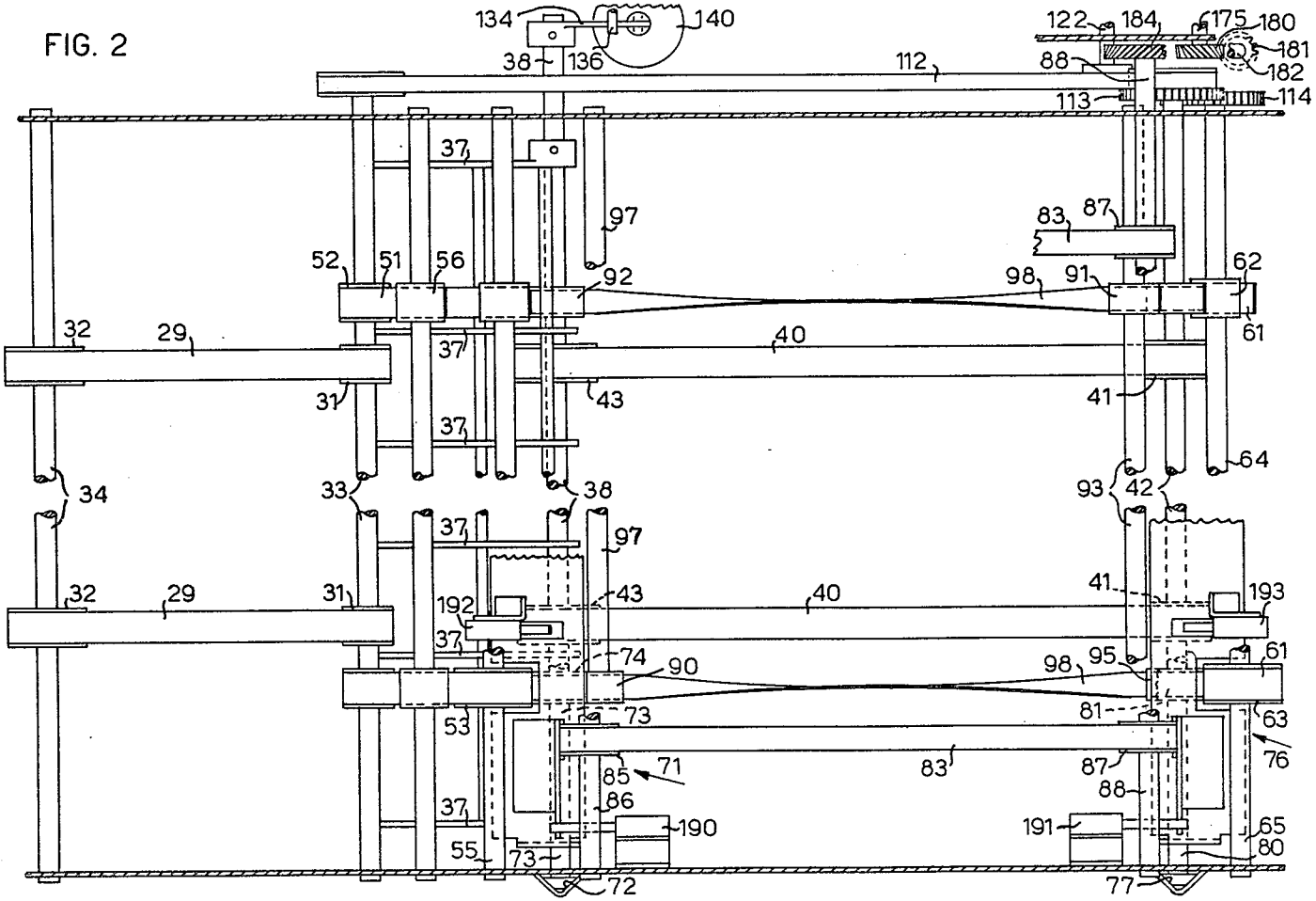
FIG. 2 is a plan view of the sorting apparatus of FIG. 1.

In FIGS. 1 and 2 the sorting apparatus 10 according to the invention is operatively connected to a copying-/duplicating machine 12 of known type, having the capability of producing copies printed on both faces (duplex mode) as well as on a single face (simplex mode), of which only the sheet output section including the output slit 13, and the console control panel are shown in FIG. 1.

The output slit 13 is aligned adjacent to the copy sheets input section of the sorting apparatus 10.

The console control panel includes a ON-OFF key 15, a PRINT key 16 for starting the execution of a predetermined copy cycle, a selector 17 for selecting the number of copies to be made during the execution of a copy cycle, and a selector 19 for selecting between a simplex or a duplex mode of operation of the machine.

The sorting apparatus 10 comprises a frame 20 on which a plurality of trays 21 is fixedly mounted in a vertically extending array and regularly spaced. Between a tray 21 and an adjacent one there is defined an opening 22, limited by the bottom of the upper tray and by the wall 23 of the lower tray, through which a copy sheet is passed for its delivery to the lower tray.

A first belt conveyor 30, for transporting the copy sheet toward the trays 21, is disposed between the input section 14 and the zone 36 at the bottom of the array of trays 21. The conveyor 30 comprises a pair of endless belts 29 mounted on rollers 31 and 32, fixedly mounted on pins 33 and 34 respectively which are rotatably mounted on the frame of the sorting apparatus.

The pair of belts 29 cooperates with the plate 35 of the frame for transporting a copy sheet therebetween toward the zone 36.

In the zone 36 a sheet deflector 37 is pivotally mounted on a pin 38 and fixedly connected to a lever 134 which is pivoted on the pin 38 and has an end connected to the armature of an electromagnet 140.

When the electromagnet is de-energized, a spring 135 urges the lever 134 and the deflector 37 toward an anticlockwise rotation, maintaining the lever 134 against the stop-pin 136 and the deflector 37 in a first position in which it deflects copy sheets transported by the conveyor 30 toward an second belt conveyor 50 extending vertically and adjacent the left side of the array of trays 21.

When the electromagnet 140 is energized, the lever 134 and the deflector 37 are rotated in a clockwise direction against the action of the spring 135 until the deflector 37 reaches a second position, shown in phantom lines in FIG. 1, in which it lets the copy sheet coming from the input section 14 be picked up by a third belt conveyor 39 lying under the bottom of the array of trays 21.

The belt conveyor 39 comprises a pair of endless belts 40 wound on driving rollers 41 fixedly mounted on a shaft 42 and on driven rollers 43 rotatably mounted on the pin 38. The belts 40 are rotated, by the action of the driving rollers 41, in an anticlockwise direction and cooperate with the plate 35 for transporting a copy sheet therebetween from the zone 36 towards the zone 45 at the right hand side bottom of the array of trays 21. A further belt conveyor 60 extends vertically at the right hand side of the array of trays 21, starting from the zone 45.

The belt conveyors 50 and 60 comprise a first pair of endless belts 51 and 61 respectively wound on rollers 52, 53 and 62, 63 respectively; the driving rollers 52 and 62 are fixedly mounted on shafts 33 and 64 respectively, while the driven rollers 53 and 63 are rotatably mounted on pins 55 and 65 respectively.

The conveyor 50 includes belt stretchers 56 and 57.

The conveyors 50 and 60 also comprise two carriages 71 and 76, slidably movable along guiding elements 72 and 77 respectively extending vertically adjacent to the lefthand side and the righthand side respectively of the array of trays 21 and to the rectilinear path section of the belts 51 and 61 respectively.

The carriages 71 and 76 are suspended to the opposite ends of a pair of toothed belts 83 which mesh, over the array of trays 21, with a pair of driven gears 85, rotatably mounted on a pin 86, and with a pair of driving gears 87 fixedly mounted on a shaft 88.

The length of the toothed belts 83 is such that when the carriage 71 is adjacent the uppermost tray 21 of the array the carriage 76 is adjacent the lowermost tray 21 of the array and vice versa.

A pair of rollers 74 (FIG. 1) is rotatably mounted on a pin 73 fixed to the carriage 71.

Another pair of rollers 81 is rotatably mounted on a pin 80 fixed to the carriage 76. A pair of deflectors 300 and 301 is also mounted on carriages 71 and 76 respectively for deflecting transported copy sheets towards trays 21.

The conveyors 50 and 60 further comprise two pairs of rollers 90 and 91, rotatably mounted on pins 97 and 93 respectively, and a pair of rollers 95 fixedly mounted on the shaft 42.

A pair of endless conveying belts 98 is partially wound on rollers 74, 81, 90, 91, 92 and 95 in such a manner as to form a closed path which, starting from rollers 74, goes in succession to the rollers 90, 95, 81, 91, 92 and again 74.

The position of the various rollers is such that the portion of belts 98 extending between rollers 90 and 95 is crossed with the portion extending between rollers 91 and 92.

The belts 98 are moved by the anticlockwise rotation of the driving rollers 95 and, owing to the above mentioned crossing, the portions of the belts 98 extending vertically between rollers 92 and 74 and between rollers 95 and 81 have the same direction of motion (i.e. from the bottom to the top of the array of trays 21) and cooperate with the belt 51 and 61 respectively for transporting therebetween a copy sheet along a path parallel to the array of trays 21 towards the top of the array at the lefthand side or the righthand side of the array, respectively.

The various driving rollers 31, 41, 52, 62 and 95 receive their rotational motion from a motor 110 (FIG. 4) by means of the motion transmission belts 111, 112 (FIG. 1) and by gears 113 and 114 fixedly mounted on the shaft 42 and 64 respectively.

Figure 3:
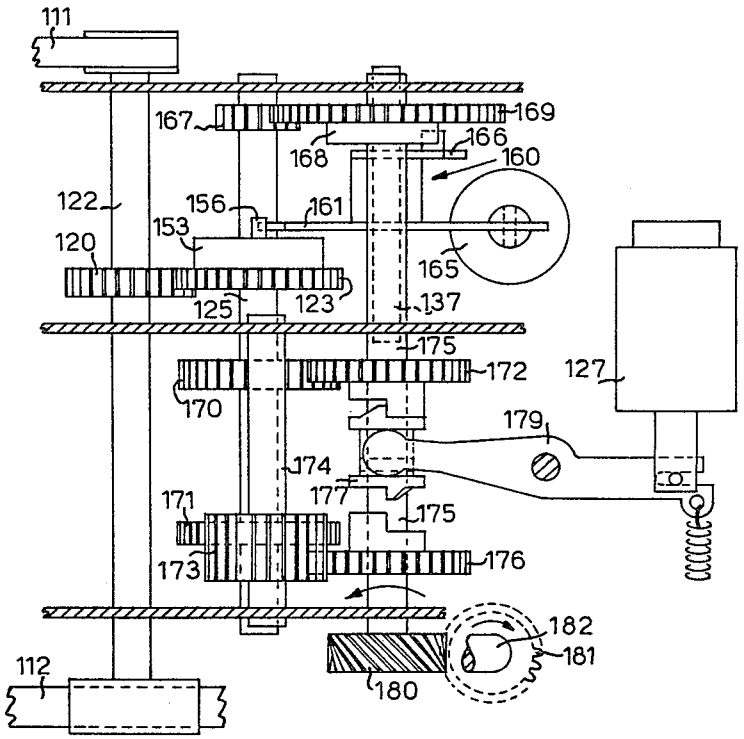
FIG. 3 is a plan view of the driving mechanism of the sorting apparatus of FIG. 1.

The driving mechanism for transmitting the motion to the carriages 71 and 76 comprises (FIGS. 3 and 4) a gear 120 keyed on a shaft 122 driven by the motor 110 through the belt 111.

The gear 120 cooperates with a gear 123 rotatably mounted on a shaft 125. The gear 123 is fixedly connected to the driving part of a clutch 153 whose driven part is keyed to the shaft 125. The disengaging tooth 156 of the clutch 153 is normally caught by a first arm 161 of a lever 160 fulcrumed on a pin 137, and in this caught position motion is not transmitted from the gear 123 to the shaft 125.

The arm 161 is also connected to the armature of an electromagnet 165 which, when energized, disengages the arm 161 from the tooth 156 and allows the rotation of the tooth 156 and of the driven part of the clutch 153.

A second arm 166 of the lever 160 cooperates with a cam 168 fixed to a gear 169 which is rotatably mounted on the shaft 175. The gear 169 meshes with the gear 167 fixed to the shaft 125, the transmission ratio of the cooperating gears 169 and 167 being of $1 \div 3$.

Figure 4:
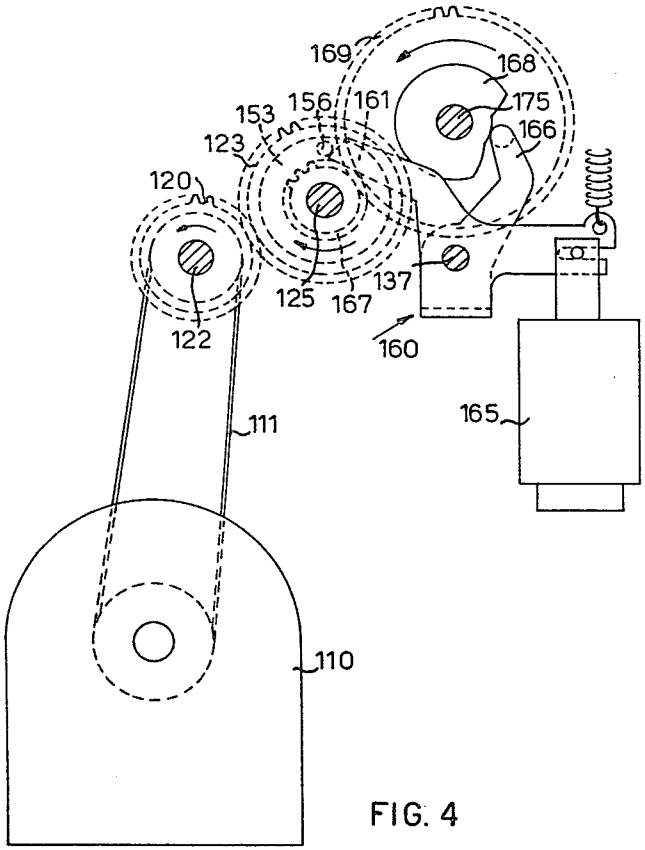
FIG. 4 is an partially diagrammatic side elevation view of the mechanisms of FIG. 3.

As it is clearly shown in FIG. 4 the contour of the cam 168 is such that, starting from the instant in which the electromagnet 165 has been energized, one turn of the shaft 175, and therefore three turns of the shaft 125, are necessary before the arm 166 cooperates again with the quieting contour of the cam 168, causing again the catching of the tooth 156 by the arm 160.

Two gears 170 and 171 are also fixed to the shaft 125. The gear 170 meshes with a gear 172 rotatably mounted on the shaft 175. The gear 171 meshes with the gear 173 rotatably mounted on the pin 174; the gear 173 meshes with a gear 176 rotatably mounted on the shaft 175, whereby the gears 172 and 176 rotate in opposite directions.

A toothed sleeve 177 is rotationally fixed, but axially slidable on the shaft 175, under the control of a lever 179, between a first position in which it transmits the rotational motion of the gear 172 to the shaft 175, and a second position in which it transmits the rotational motion of the gear 176 to the shaft 175. The lever 179 is connected to the armature of an electromagnet 127 and is spring biased to maintain the toothed sleeve in its first position, while, when the electromagnet is energized, the lever 179 is rotated anticlockwise to move the toothed sleeve 177 to its second position; since the shaft 175 receives the motion from the shaft 125, it rotates for one turn in a clockwise or anticlockwise direction depending on the position of the toothed sleeve 177, for each energization of the electromagnet 165.

The incremental motion of the shaft 175 is transmitted through the helical gear pair 180, 181, the shaft 182 and the helical gear pair 183, 184 to the shaft 88 which moves the toothed belts 83 and therefore incrementally moves the carriages 71 and 76 along the array of trays 21. For every three turns of the shaft 125 there is a corresponding incremental displacement of the carriage 71 from a tray 21 to the adjacent one, toward the top or the bottom depending on the position of the toothed sleeve 177, and vice versa, for the carriage 76.

Figure 5:
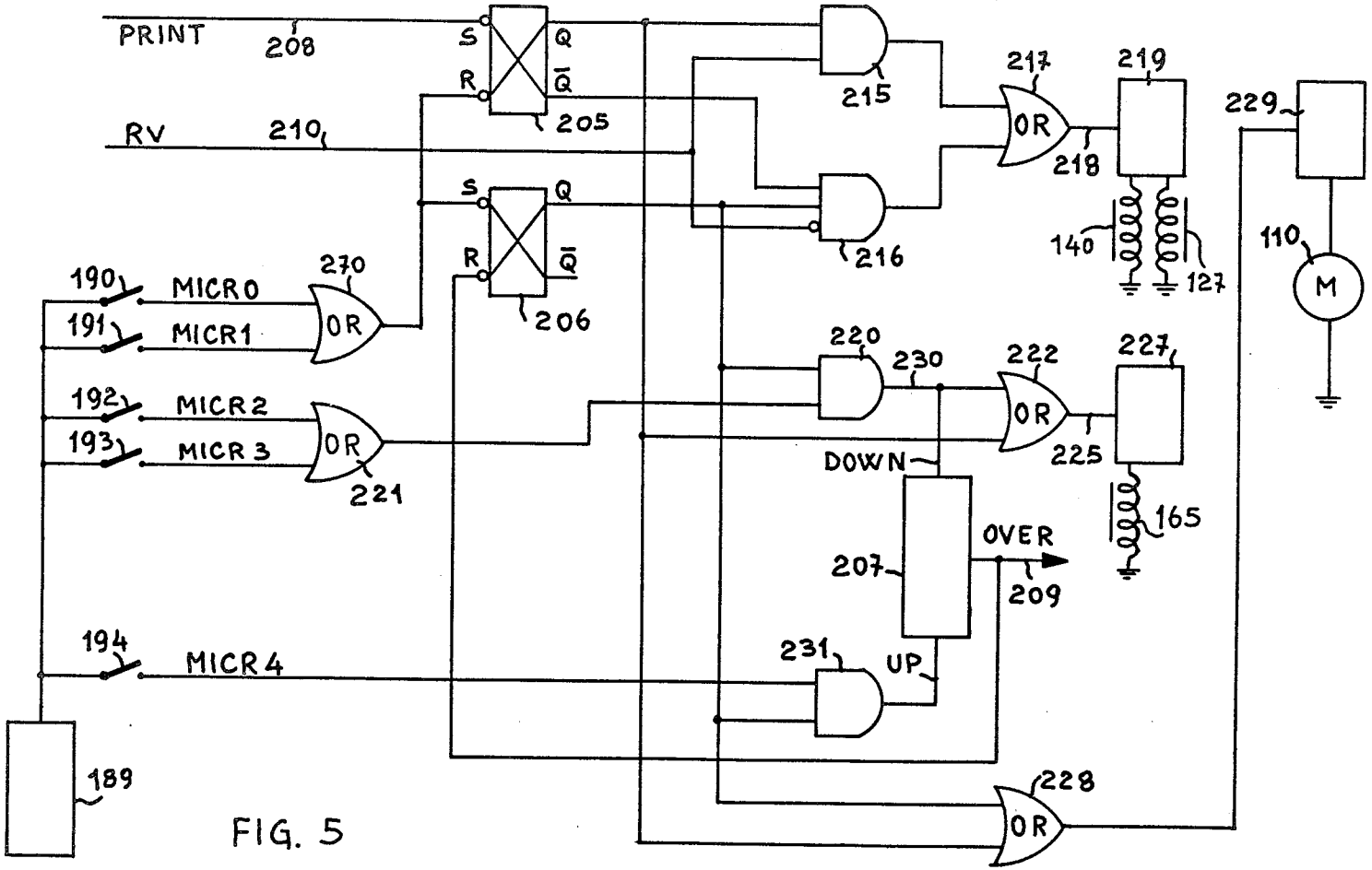
FIG. 5 is a logic diagram of the control circuit of the sorting apparatus of FIG. 1.

The electrical and logical control circuit of the sorting apparatus 10 (FIGS. 1 and 5) comprises a first pair of microswitches 190 and 191 mounted at the top of the array of trays 21 on the left-hand side and the righthand side respectively of the array, with their arms in the paths of the carriages 71 and 76 respectively. The microswitches 190 and 191 are connected to a power source 189 and are switched on when the respective carriages 71 and 76 reach the top of the array of trays 21, generating corresponding logical signals at 1 level MICRO 0 and MICR 1 respectively.

A second pair of microswitches 192 and 193 is mounted on the carriages 71 and 76 respectively in the path of the conveyed copy sheets. The microswitches 192 and 193 are connected to the power source 189 and generate logical signals at 1 level MICR 2 and MICR 3 respectively when they are switched on by a conveyed sheet.

A further microswitch 194 is mounted in the input section of the sorting apparatus 10 and is connected to the power source, and generates a logical signal at 1 level, MICR 4, when it is switched on by the passage of an entering copy sheet.

The control circuit further comprises a flip-flop 205, which is set by a signal PRINT generated by the key 16, when depressed, and transmitted into the sorting apparatus from the connected copying machine through the wire 208.

The flip-flop 205 is reset by the signals MICRO 0 or MICR 1 through the OR circuit 270 through which is also set a flip-flop 206.

A binary counter 207, of known type and having two as a maximum counting capacity, is incremented by one unit for each 1 level signal received through the input UP and decremented by one unit for each 1 level signal received through the input DOWN.

When the counter 207 reaches its maximum capacity and a further 1 level logical signal is applied to the input UP it generates a logical 1 level signal OVER on its output wire 209 which is connected to the reset input of the flip-flop 206 and to the control unit of the copying machine 12.

A wire 210 is connected to the selector 19 of the copying machine and transmits to the sorting apparatus a signal RV which is at logical 1 level when the duplex mode is selected, and at logical 0 level when the simplex mode is selected.

The AND gate 215 of the output Q of the flip-flop 205 and of the signal RV, and the AND gate 216 of the output Q of the flip-flop 205, of the logically inverted signal RV and of the output Q of flip-flop 206 are connected to the OR circuit 217, the output 218 of which activates, when at logical 1 level, the driving circuit 219 of the electromagnets 140 and 127.

The OR circuit 221, between the signals MICR 2 and MICR 3, and the output Q of the flip-flop 206 are connected to the AND gate 220 the output of which is connected to the OR circuit 222 with the output Q of the flip-flop 205.

The output 225 of the OR circuit 222 activates, when at a logical 1 level, the driving circuit 227 which after a suitable delay energized the electromagnet 165.

The OR circuit 228 between the outputs Q of the flip-flops 205 and 206, activates, when at logical 1 level, the driving circuit 229 of the motor 110, whereby the motor 110 rotates only when at least one of the flip-flops 205 and 206 has been set.

The output 230 of the AND gate 220 is also connected to the input DOWN of the counter 207.

The signal MICR 4 and the output Q of the flip-flop 206 are connected through the AND gate 231 to the input UP of the counter 207.

The operation of the above devices and circuits will now be described, assuming as initial conditions that the motor 110 is stationary, that none of the electromagnets 140, 127, 165 is energized, and that the positions of the various mechanical elements are those shown in FIGS. 1–4, while the carriages 71 and 76 are in intermediate positions along the array of trays 21, and assuming also the operator has selected the duplex mode of operation whereby the signal RV is at logical 1 level (RV=1).

When the operator depresses the key 16, the flip-flop 205 is set (Q=1) and therefore the motor 110 rotates and also all the belts of the conveyors 30, 39, 50 and 60, are in motion.

Since RV=1, the electromagnets 140 and 127 are energized and consequently, the deflector 37 is rotated to the position indicated in phantom line in FIG. 1 and the toothed sleeve 177 cooperates with the gear 176. Moreover, since the flip-flop 205 has been set, the electromagnet 165 is energized and, consequently, the rotation of the motor 110 is transmitted, through the clutch 153 and the gear 176, to the shaft 175 which rotates anticlockwise, with reference to FIG. 4, and causes the motion of the carriage 76 towards the bottom of the array of tray 21, and of the carriage 71 towards the top of the array of tray 21.

The motion of the carriages continues until the electromagnet 165 controlling the clutch 153 is maintained energized and therefore until the microswitch 190 is switched on by the carriage 71 and the signal MICRO resets the flip-flop 205 (Q=0) and sets the flip-flop 206 (Q=1). With the reset of flip-flop 205 also the electromagnets 140 and 127 are de-energized and the deflector 37 is rotated to the position in which it deflects the sheets towards the conveyor 50, while the toothed sleeve 177 cooperates with the gear 172. During the time in which the above described preliminary operations have been executed, the copying machine has started its copy-cycle, and therefore, with some delay with respect to the set of the flip-flop 206, the first copy sheet printed on both faces (since RV=1) is delivered from the copying machine output 13 and enters into the input section 14 of the sorting apparatus 10 with the face bearing the second image turned up. This copy sheet swiches on the microswitch 194 and a signal MICR 4 is generated, which increments by one unit the counter 207. The entered copy sheet is transported by the conveyors 30 and 50 along the left side of the array of tray 21 until it reaches the uppermost tray 21 of the array, wherein it is delivered with the face bearing the second image turned up.

During the delivery of the entered sheet to the uppermost tray 21, the microswitch 192 is switched on and a corresponding signal MICR 2 is generated which causes a clockwise rotation of three turns of the shaft 125, whereby the carriage 71 will be lowered and positioned in correspondence to the second tray 21 of the array starting from the top.

Moreover the signal MICR 2 decrements the counter 207 by one unit. At the time in which the signal MICR 2 has been generated, another copy sheet might have entered into the sorting apparatus 10 and might have again incremented the counter 207.

In this case this new entered sheet will follow the same path of the first sheet and will be discharged in the second tray 21 of the array starting from the top.

The task of the counter 207 is that of signalling abnormal conditions in conveying the entered copy sheets (for instance due to jams). In fact the counter 207 generates the signal OVER, which resets the flip-flop 206 and therefore disables the sorting apparatus 10, in a situation in which three copy sheets have entered in succession in the sorting apparatus 10 (two consecutive signals MICR 1) and in the meantime no copy sheet has been delivered to a tray 21 (lack of signals MICR 2 or MICR 3); this situation is indicative of a jam of a copy sheet along its path.

The signal OVER is also transmitted to the copying machine which will deflect the produced copy sheets onto a path bypassing the sorting apparatus.

Analogously, if the simplex mode is selected by the operator (RV=0) and the key 16 is depressed, the carriages 71 and 76 will move, by the energization of flip-flop 205, in the opposite direction, with respect to the above described situation (RV=1), until the carriage 76 reaches the topmost tray 21 of the array.

By the energization of flip-flop 206 the deflector 37 will assume the position indicated in phantom lines in FIG. 1 and the copy sheets, entered in the sorting apparatus with the image bearing surface faced up, will be transported through the path extending along the right-hand side of the array of trays 21 by the conveyors 30, 39 and 60 and will be delivered to the trays 21 with the image bearing surface faced down. For each copy sheet delivered, a signal MICR 3 will be generated and the carriage 76 will be positioned adjacent to a lower tray, and so on until the end of the copy cycle.

By the above described invention sorting of copy sheets produced in both simplex and duplex modes of operation is accomplished in a simple and reliable manner. Two sheets paths are used to effect entry into the tray array, duplex copies are delivered to the tray with the second image faced up, while simplex copies are delivered faced down.

While there have been described and shown and pointed out the fundamental novel features of the invention, it will be understood that various omissions and substitutions and changes in form and details of the devices illustrated and in its operation may be made by those skilled in the art without departing from the spirit of the invention.

What we claim is:

1. Sorting apparatus for receiving sheets from a reproduction machine distributing in both simplex and duplex modes of operation, comprising:

a frame;

an array of regularly spaced tray members arranged along a predetermined direction and fixedly connected to said frame;

single transport means defining a first path and a second path extending parallel to said predetermined direction, for selectively moving sheets, said first path being adjacent one side of said array and said second path being adjacent the opposite side of said array, said transport means extending along said one side and said opposite side of said array;

deflecting means for selectively deflecting sheets toward either said first or said second path according to whether simplex or duplex sorting is required;

first delivering means mounted on said transport means and incrementally movable along said first path for delivering sheets transported along said first path into a selected tray member of said array;

second delivering means mounted on said transport means and connected to said first delivering means, incrementally movable along said second path for delivering sheets transported along said second path into a selected tray member of said array;

connecting means connecting said first and second delivering means for incrementally moving them in opposite directions along said first and second paths respectively; and single control means to control the incremental movement of said first and second delivering means, whereby, when said first delivering means moves along said first path for indexing said tray members according to one of two opposite predetermined sequences, according to whether simplex or duplex sorting is required, said second delivering means always indexes said tray member according to a sequence opposite to the indexing sequence of said first delivering means.

2. Sorting apparatus according to claim 1 further comprising:

an up-down counter;

first sensing means for sensing each input of a sheet from said reproduction machine and for incrementing each time said counter by one;

second sensing means for sensing each delivery of a sheet by said first delivering means and for decrementing each time said counter by one;

third sensing means for sensing each delivery of a sheet by said second delivering means and for decrementing each time said counter by one; and means connected to said counter for signaling a sheet-jam and disabling the sorting operation when the counter increments up to a predetermined value.

3. Sorting apparatus according to claim 1, wherein said transport means includes an endless conveying belt, extending along a closed path, including said first and said second path, and having at least two parts crossed therebetween, arranged between said first and said second paths, whereby said endless belt is moved in said first path and in said second path in the same advancing direction.

4. Sorting apparatus according to claim 3 wherein said array extends vertically, said first and second delivery means are mounted respectively on first and second carriages slidably movable along guides extending vertically along said first and second paths respectively and wherein said guiding and advancing means include a first roller rotatably mounted on said first carriage and a second roller rotatably mounted on said second carriage said common belt being partially wound around said first and second rollers.

5. Sorting apparatus according to claim 4 wherein said connecting means includes a toothed transmission belt, said belt having an end connected to said first carriage and the opposite end connected to said second carriage and guided along a path having a first section parallel to said first path, a second section extending over the top of the array from one side to the opposite side of the array, and a third section parallel to said second path, the length of said toothed belt being such that when the first delivering means indexes the topmost tray member of the array the second delivering means indexes the lowermost tray member of the array, said connecting means including a gear meshing with the toothed belt and rotated incrementally.

* * * * *